US008537150B2

(12) United States Patent
Cheng et al.

(10) Patent No.: US 8,537,150 B2
(45) Date of Patent: Sep. 17, 2013

(54) METHOD AND CONTROL BOARD FOR ELIMINATING POWER-OFF RESIDUAL IMAGES IN DISPLAY AND DISPLAY USING THE SAME

(75) Inventors: Chih-Feng Cheng, Taoyuan County (TW); Wei-Chi Lin, Hsinchu County (TW); Chieh-Hui Wang, Taipei County (TW); Kuo-Sheng Lai, Taoyuan County (TW)

(73) Assignee: Hannstar Display Corporation, New Taipei (TW)

( * ) Notice: Subject to any disclaimer, the term of this patent is extended or adjusted under 35 U.S.C. 154(b) by 617 days.

(21) Appl. No.: 12/482,416

(22) Filed: Jun. 10, 2009

(65) Prior Publication Data

US 2010/0026673 A1 Feb. 4, 2010

(30) Foreign Application Priority Data

Jul. 29, 2008 (TW) ..... 97128692 A

(51) Int. Cl.
*G09G 5/00* (2006.01)

(52) U.S. Cl.
USPC ..... 345/211

(58) Field of Classification Search
USPC ..... 345/211, 87, 94–95
See application file for complete search history.

(56) References Cited

U.S. PATENT DOCUMENTS

| | | | | |
|---|---|---|---|---|
| 6,731,258 | B2 * | 5/2004 | Lin et al. | 345/87 |
| 2005/0179633 | A1 * | 8/2005 | Inada | 345/98 |
| 2006/0022971 | A1 * | 2/2006 | Luo et al. | 345/211 |
| 2007/0139347 | A1 * | 6/2007 | Shen | 345/100 |
| 2008/0238852 | A1 * | 10/2008 | Tsai | 345/98 |
| 2008/0259061 | A1 * | 10/2008 | Lin | 345/204 |

FOREIGN PATENT DOCUMENTS

| | | |
|---|---|---|
| CN | 101271671 | 9/2008 |
| TW | I263962 | 10/2006 |
| TW | 200725562 | 7/2007 |

OTHER PUBLICATIONS

"First Office Action of China Counterpart Application", issued on Jun. 22, 2011, p. 1-p. 8.
"Office Action of Taiwan Counterpart Application", issued on Nov. 22, 2012, p. 1-p. 7.

* cited by examiner

*Primary Examiner* — Chanh Nguyen
*Assistant Examiner* — Jonathan Blancha
(74) *Attorney, Agent, or Firm* — Jianq Chyun IP Office

(57) ABSTRACT

A method and a control board for eliminating power-off residual images in a display and a display using the same are provided. The method includes the following steps of providing a first voltage to compensate a second voltage which is used for sequentially turning on all scan lines within a display panel when the display is in power-off, and then forming a third voltage to turn on all scan lines within the display panel according to the compensated second voltage.

21 Claims, 3 Drawing Sheets

METHOD AND CONTROL BOARD FOR ELIMINATING POWER-OFF RESIDUAL IMAGES IN DISPLAY AND DISPLAY USING THE SAME

CROSS-REFERENCE TO RELATED APPLICATION

This application claims the priority benefit of Taiwan application serial no. 97128692, filed on Jul. 29, 2008. The entirety of the above-mentioned patent application is hereby incorporated by reference herein and made a part of this specification.

BACKGROUND OF THE INVENTION

1. Field of the Invention

The present invention relates to a flat-panel display technology, more particularly, the present invention relates to a liquid crystal display without power-off residual images.

2. Description of the Related Art

In recent years, with great advance in the fabricating techniques of opto-electronics and semiconductor devices, flat panel displays (FPDs) have been vigorously developed. Among the FPDs, a liquid crystal display (hereinafter "LCD") has become the mainstream display product due to its advantages of outstanding space utilization efficiency, low power consumption, free radiation, and low electrical field interference.

In conventional, the power-off residual images in the liquid crystal display (LCD) are always caused by electric charges still remaining in pixels of the LCD panel when the LCD is in power-off. Accordingly, a low voltage detection IC is embedded into the conventional control board for outputting a low voltage signal to an XAO pin of the gate driver when the LCD is in power-off, so that the gate driver would turn on all scan lines in the LCD panel to neutralize electric charges remaining in pixels of the LCD panel so as to achieve the purpose of eliminating power-off residual images in the LCD.

However, in actually, since the velocity of discharge of a gate driver turn-on voltage (i.e. $V_{GH}$) supplied to the gate driver and generated from a power supply unit of the control board is too fast when the LCD is in power-off, so that the gate driver is incapable of successfully turning on all scan lines of the LCD panel to neutralize electric charges remaining in pixels of the LCD panel. Therefore, the power-off residual images eventually produce when the LCD is in power-off.

SUMMARY OF THE INVENTION

The present invention is directed to a method and a control board for eliminating power-off residual images produced when the LCD is in power-off.

The present invention provides a method for eliminating power-off residual images in a display. The method includes the following steps of providing a first voltage to compensate a second voltage which is used for sequentially turning on all of scan lines within a display panel when the display is in power-off, and then forming a third voltage to turn on the scan lines according to the compensated second voltage.

According to an embodiment of the present invention, the method is adapted for eliminating residual images produced when a liquid crystal display (LCD) is in power-off.

The present invention also provides a control board including a compensation unit and a low voltage detection unit. The compensation unit is used for compensating a second voltage which is used for sequentially turning on all of scan lines within a display panel according to a first voltage when a display is in power-off. The low voltage detection unit is used for detecting whether a logic operating voltage is lower than a predetermined value or not when the display is in power-off. When the logic operating voltage is lower than the predetermined value, the low voltage detection unit outputs a low voltage signal to a gate driver, such that the gate driver turns on the scan lines according to a third voltage, wherein the third voltage is formed by the compensated second voltage.

According to an embodiment of the present invention, the control board further includes a power supply unit for at lest providing the first, the second and the logic operating voltages.

According to an embodiment of the present invention, the compensation unit includes a diode having an anode receiving the first voltage and a cathode receiving the second voltage.

According to an embodiment of the present invention, the cathode of the diode receives the second voltage through a current limiting resistor.

According to an embodiment of the present invention, the gate driver is directly disposed on the display panel.

According to an embodiment of the present invention, the display at least includes an LCD.

The present invention also provides a display including a display panel and a control board provided by the present invention.

According to an embodiment of the present invention, a velocity of discharge of the first voltage is slower than a velocity of discharge of the second voltage.

According to an embodiment of the present invention, the second voltage is incapable of turning on the scan lines within the display panel when the display is in power-off.

According to an embodiment of the present invention, the second voltage is a gate driver turn-on voltage ($V_{GH}$).

According to an embodiment of the present invention, the first voltage at least includes a common voltage ($V_{COM}$).

The method and the control board provided by the present invention firstly employ the common voltage ($V_{COM}$) to compensate the gate driver turn-on voltage ($V_{GH}$) when the LCD is in power-off, and then turning on all scan lines within the display panel to rapidly neutralize electric charges remaining in pixels of the display panel according to the compensated gate diver turn-on voltage. Therefore, the power-off residual images produced when the LCD is in power-off would be eliminated.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
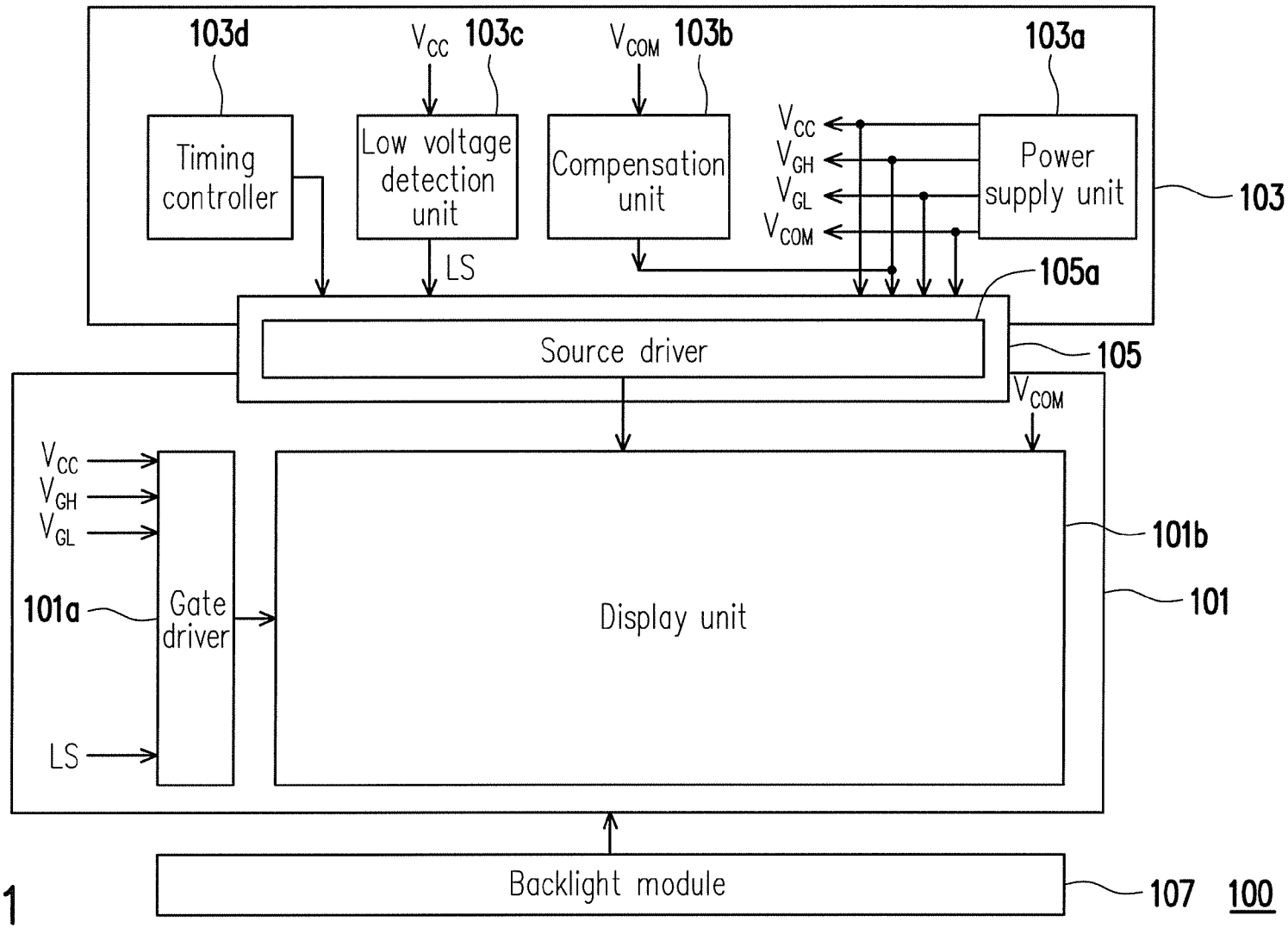
FIG. 1 is a system diagram of an LCD according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

The present invention is directed to effectively eliminate power-off residual images produced when the LCD is in power-off. Below, the characteristics and advantages of the technique in the present invention will be described in detail.

FIG. 1 is a system diagram of an LCD according to an embodiment of the present invention. Referring to FIG. 1, the LCD 100 includes an LCD panel 101, a control board 103, a flexible printed circuit board (FPC) 105 and a backlight module 107 for providing backlight source to the display panel 101.

In the present embodiment, the LCD panel 101 includes a gate driver 101*a* and display unit 101*b*. The gate driver 101*a* is directly disposed on one side of the glass substrate of the LCD 101 through a chip-on-glass (COG) process. The display unit 101*b* includes a plurality of scan lines (not shown in FIG. 1), and each scan line includes a plurality of pixels.

The control board 103 includes a power supply unit 103*a*, a compensation unit 103*b*, a low voltage detection unit 103*c* and a timing controller (T-con) 103*d*. In the present embodiment, the control board 103 connects with the LCD panel 101 through the FPC 105 manufactured by chip-on-film (COF) process, wherein a source driver 105*a* is disposed on the FPC 105.

In general, the operations of the gate and the source drivers are controlled by the timing controller 103*d* through the FPC 105, so as to further collocate with the backlight module 107 for making the display unit 101*b* display images to user watch. However, such display technical is not the focal point for the present invention, and one person having ordinary skilled in the art should be known such display technical, so that the detail about such display technical would be omitted herein. Below, the focal point of the technique in the present invention will be described in detail.

The power supply unit 103*a* is used for providing a plurality of system voltages, such as a compensation voltage (for example, a common voltage $V_{com}$ in the present invention), a enabling voltage (for example, a gate driver turn-on voltage $V_{LH}$ in the present invention), a disabling voltage (for example, a gate driver turn-off voltage $V_{GL}$ in the present invention), and a logic operating voltage $V_{cc}$, which all are needed by the LCD panel 101.

Referring to Description of the Related Art, it can be known that, in conventional, since the velocity of discharge of a gate driver turn-on voltage (i.e. $V_{GH}$) supplied to the gate driver and generated from a power supply unit of the control board is too fast when the LCD is in power-off, so that the gate driver is incapable of successfully turning on all scan lines of the LCD panel to neutralize electric charges remaining in pixels of the LCD panel. In other words, the gate driver turn-on voltage (i.e. $V_{GH}$) supplied to the gate driver and generated from the power supply unit of the control board is incapable of turning on all scan lines of the LCD panel when the conventional LCD is in power-off. Therefore, the power-off residual images eventually produce when the conventional LCD is in power-off.

Accordingly, the compensation unit 103 of the present embodiment would compensate the enabling voltage (i.e. $V_{GH}$) according to the compensation voltage (i.e. $V_{COM}$) when the LCD 100 is in power-off, so that the gate driver 101*a* is still capable of turning on all scan lines within the LCD panel 101*b* when the LCD 100 is in power-off.

It should be noted that the reason why the present embodiment employs the common voltage $V_{COM}$ to compensate the gate diver turn-on voltage $V_{GH}$. This is because of the velocity of discharge of the common voltage $V_{COM}$ is slower than the velocity of discharge of the gate driver turn-on voltage $V_{GH}$ when the LCD 100 is in power-off. However, the present invention is not limited to employ the common voltage $V_{COM}$ to compensate the gate diver turn-on voltage $V_{GH}$. In other words, any system voltage, which is different from the common voltage $V_{COM}$ and which velocity of discharge is slower than the gate diver turn-on voltage $V_{GH}$ when the LCD 100 is in power-off, can be replaced with the common voltage $V_{COM}$ and employed to compensate the gate diver turn-on voltage $V_{GH}$.

Figure 2:
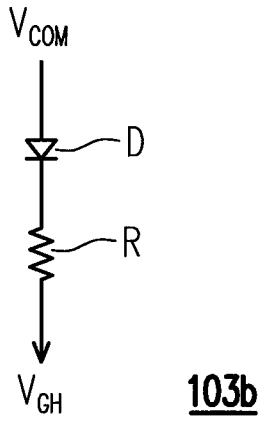
FIG. 2 is a circuit diagram of a compensation unit according to an embodiment of the present invention.

For clearly explaining why the compensation unit 103 can be compensated the enabling voltage (i.e. the gate diver turn-on voltage $V_{GH}$) according to the compensation voltage (i.e. the common voltage $V_{COM}$) when the LCD 100 is in power-off. FIG. 2 is a circuit diagram of the compensation unit according to an embodiment of the present invention. Referring to FIGS. 1 and 2 both, the compensation unit 103*b* includes a diode D and a current limiting resistor R. An anode of the diode D is used for receiving the compensation voltage (i.e. the common voltage $V_{COM}$), and a cathode of the diode D is used for receiving the enabling voltage (i.e. the gate diver turn-on voltage $V_{GH}$) through the current limiting resistor R. The resistance value of the current limiting resistor R can be determined by any design requirements.

In the present embodiment, since the velocity of discharge of the common voltage $V_{COM}$ is slower than the velocity of discharge of the gate diver turn-on voltage $V_{GH}$ when the LCD 100 is in power-off, so that when the voltage level of the common voltage $V_{COM}$ is higher than the gate diver turn-on voltage $V_{GH}$ to a forward bias of the diode D, the diode D then will conduct for making the common voltage $V_{COM}$ to compensate the gate diver turn-on voltage $V_{GH}$.

From the above, referring to FIGS. 1 and 2 both again, the low voltage detection unit 103*c*, such as a low voltage detection IC, is used for detecting whether the logic operating voltage $V_{CC}$ is lower than a predetermined value when the LCD 100 is in power-off, wherein the predetermined value can be determined by any design requirements. In the present embodiment, when the logic operating value $V_{CC}$ is lower than the predetermined value, the low voltage detection unit 103*c* would output a low voltage signal LS to the XAO pin of the gate driver 101*a* through the FPC 105, and then the gate driver 101*a* would turn on all scan lines within the display unit 101*b* to rapidly neutralize electric charges remaining in the pixels of each scan line according to the compensated enabling voltage (i.e. the compensated gate driver turn-on voltage $V_{GH}$). Therefore, the power-off residual images produced when the LCD 100 is in power-off would be eliminated effectively.

For one person having ordinary skilled in the art to know what the technical efficiency of the compensation unit 103*b* in the present embodiment. Below, several experimental waveform diagrams will show for one person having ordinary skilled in the art to reference.

Figure 3:
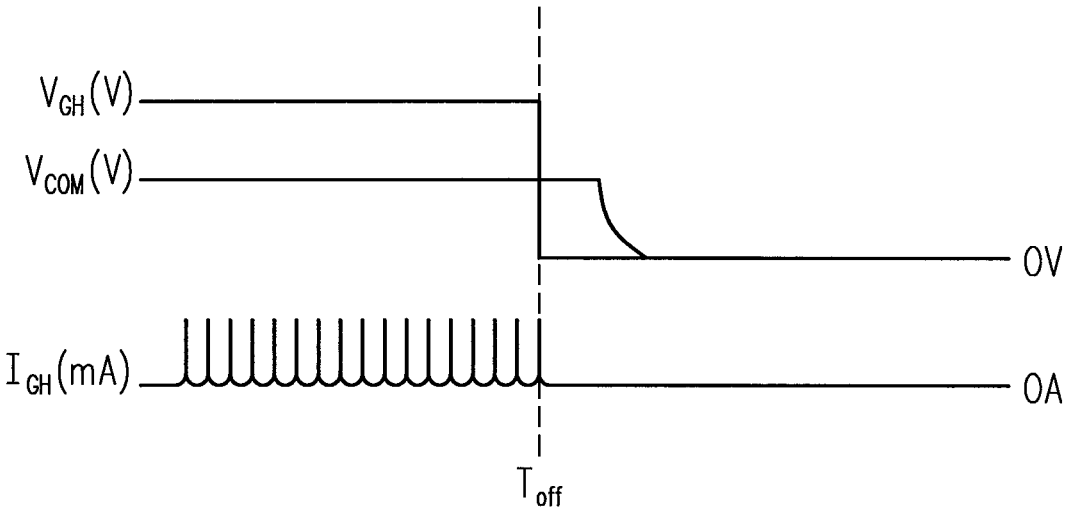
FIG. 3 is a waveform diagram of a gate driver turn-on voltage ($V_{GH}$), a common voltage ($V_{COM}$) and a gate driver turn-on current ($I_{GH}$) in conventional.
Figure 4:
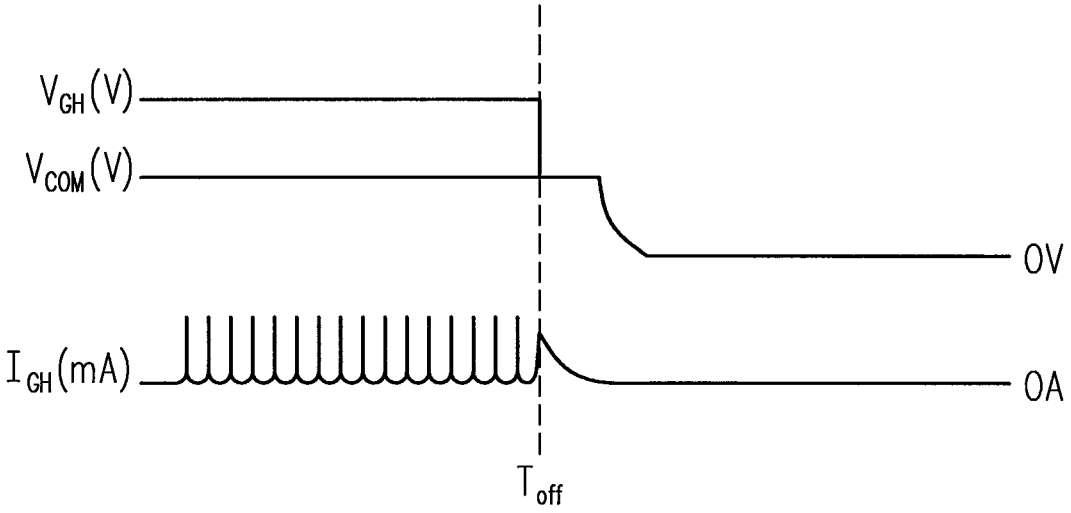
FIG. 4 is a waveform diagram of a gate driver turn-on voltage ($V_{GH}$), a common voltage ($V_{COM}$) and a gate driver turn-on current ($I_{GH}$) according to an embodiment of the present invention.

FIG. 3 is a waveform diagram of a gate driver turn-on voltage ($V_{GH}$), a common voltage ($V_{COM}$) and a gate driver turn-on current ($I_{GH}$) in conventional. FIG. 4 is a waveform diagram of a gate driver turn-on voltage ($V_{GH}$), a common voltage ($V_{COM}$) and a gate driver turn-on current ($I_{GH}$) according to an embodiment of the present invention. Referring to FIGS. 3 and 4 both, the symbol Toff in FIGS. 3 and 4 represents the power-off timing of the LCD. Accordingly, in FIG. 3, the gate driver turn-on voltage ($V_{GH}$) rapidly discharges to 0V when the conventional LCD is in power-off, so that the gate driver turn-on current ($I_{GH}$) is incapable of turning on anyone of scan lines within the LCD panel when the LCD is in power-off.

On the contrary, in FIG. 4, since the gate driver turn-on voltage ($V_{GH}$) would be compensated by the common voltage ($V_{COM}$) when the LCD 100 is in power-off, so that the gate driver turn-on voltage ($V_{GH}$) would not rapidly pull down to 0V. Accordingly, the gate driver turn-on current ($I_{GH}$) of the present invention is capable of turning on all scan lines within the LCD panel 101 to neutralize electric charges remaining the pixels of the LCD panel 101 when the LCD 100 is in power-off. Therefore, the power-off residual images produced when the LCD 100 is in power-off would be eliminated effectively.

Figure 5:
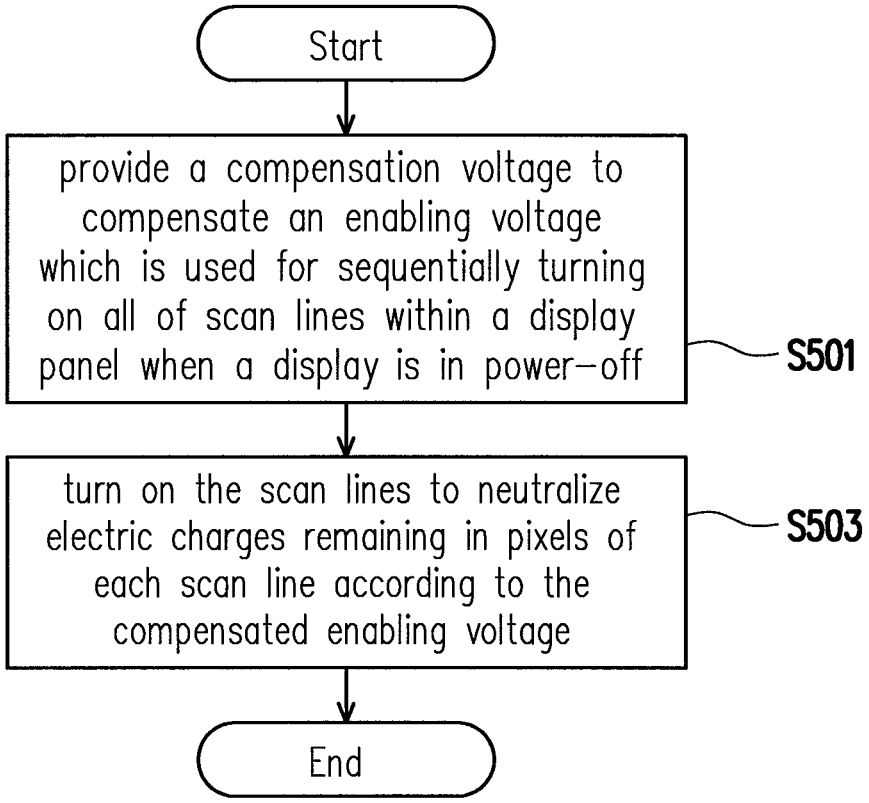
FIG. 5 is a flow chart of a method for eliminating power-off residual images in a display according to an embodiment of the present invention.

According to the content disclosed in the above embodiment, a method for eliminating power-off residual images in a display is summarized below for those skilled in the art. FIG. 5 is a flow chart of a method for eliminating power-off residual images in a display according to an embodiment of the present invention. Referring to FIG. 5, the method of the present embodiment includes the following steps. Firstly, as shown in step S501, provide a compensation voltage to compensate an enabling voltage which is used for sequentially turning on all of scan lines within a display panel when a display is in power-off. Next, as shown in step S503, turn on the scan lines to neutralize electric charges remaining in pixels of each scan line according to the compensated enabling voltage.

The method of the present embodiment is at least adapted for eliminating residual images produced when an LCD is in power-off. Moreover, the velocity of discharge of the compensation voltage (for example, the common voltage $V_{COM}$ in the present embodiment) is slower than the velocity of discharge of the enabling voltage (for example, the gate drive turn-on voltage $V_{GH}$ in the present embodiment), and the enabling voltage is incapable of turning on anyone of scan lines within the display panel when the LCD is in power-off. Furthermore, in accordance with the above embodiment, it can be known that when the LCD is in power-off, all of compensation mechanizes/methods and circuits to compensate the gate driver turn-on voltage ($V_{GH}$) should fall into the scope of the present invention.

In summary, the method and the control board provided by the present invention firstly employ the common voltage ($V_{COM}$) to compensate the gate driver turn-on voltage ($V_{GH}$) when the LCD is in power-off, and then turning on all scan lines within the display panel to rapidly neutralize electric charges remaining in pixels of the display panel according to the compensated gate diver turn-on voltage. Therefore, the power-off residual images produced when the LCD is in power-off would be eliminated.

It will be apparent to those skills in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for eliminating power-off residual images in a display, comprising:

providing a first voltage to compensate a second voltage which is used for turning on scan lines of a display panel when the display is in power-off; and forming a third voltage to turn on the scan lines according to the compensated second voltage, wherein the first voltage is a DC common voltage of the display panel, the second voltage is a gate driver turn-on voltage, and when the DC common voltage is greater than the gate driver turn-on voltage by a specific voltage, the DC common voltage begins to compensate the gate driver turn-on voltage so as to form the third voltage for turning on all the scan lines of the display panel, wherein the third voltage is smaller than the gate driver turn-on voltage, and is substantially equal to the DC common voltage of the display panel.

2. The method according to claim 1, wherein the discharge of the first voltage is slower than the discharge of the second voltage when the display is in power-off.

3. The method according to claim 2, wherein the second voltage is incapable of turning on the scan lines when the display is in power-off.

4. The method according to claim 1, wherein the method is at least adapted for eliminating residual images produced when a liquid crystal display (LCD) is in power-off.

5. A control board, comprising:

a compensation unit, for compensating a second voltage which is used for turning on scan lines of a display panel by a first voltage when a display is in power-off, wherein the first voltage is a DC common voltage of the display panel, the second voltage is a gate driver turn-on voltage, and when the DC common voltage is greater than the gate driver turn-on voltage by a specific voltage, the DC common voltage begins to compensate the gate driver turn-on voltage so as to form a third voltage for turning on all the scan lines of the display panel; and a voltage detection unit, for detecting whether a voltage is lower than a predetermined value or not when the display is in power-off, wherein when the voltage is lower than the predetermined value, the voltage detection unit outputs a signal to a gate driver, such that the gate driver turns on the scan lines according to the third voltage, wherein the third voltage is formed by the compensated second voltage, wherein the third voltage is smaller than the gate driver turn-on voltage, and is substantially equal to the DC common voltage of the display panel.

6. The control board according to claim 5, wherein the discharge of the first voltage is slower than the discharge of the second voltage when the display is in power-off.

7. The control board according to claim 6, wherein the second voltage is incapable of turning on the scan lines when the display is in power-off.

8. The control board according to claim 5, further comprising:

a power supply unit, for at least providing the first voltage, the second voltage and the voltage.

9. The control board according to claim 8, wherein the compensation unit comprises a diode having an anode directly receiving the first voltage and a cathode receiving the second voltage, and the specific voltage is a forward bias of the diode.

10. The control board according to claim 9, wherein the cathode of the diode receives the second voltage through a current limiting resistor.

11. The control board according to claim 5, where the gate driver is directly disposed on the display panel.

12. The control board according to claim 5, wherein the display at least comprises a liquid crystal display (LCD).

13. A display, comprising:

a display panel having a plurality of scan lines; and a control board, coupled to the display panel, for compensating a second voltage which is used for turning on the scan lines by a first voltage when the display is in power-off, such that a gate driver turns on the scan lines according to a third voltage, wherein the third voltage is formed by the compensated second voltage, wherein the first voltage is a DC common voltage of the display panel, the second voltage is a gate driver turn-on voltage, and when the DC common voltage is greater than the gate driver turn-on voltage by a specific voltage, the DC common voltage begins to compensate the gate driver turn-on voltage so as to form the third voltage for turning on all the scan lines of the display panel, wherein the third voltage is smaller than the gate driver turn-on voltage, and is substantially equal to the DC common voltage of the display panel.

14. The display according to claim 13, wherein the discharge of the first voltage is slower than the discharge of the second voltage when the display is in power-off.

15. The display according to claim 14, wherein the second voltage is incapable of turning on the scan lines when the display is in power-off.

16. The display according to claim 13, wherein the control board comprises:

a compensation unit, for compensating the second voltage by the first voltage when the display is in power-off; and a voltage detection unit, for detecting whether a voltage is lower than a predetermined value or not, wherein when the voltage is lower than the predetermined value, the low voltage detection unit outputs a signal to the gate driver, such that the gate driver turns on the scan lines by the third voltage.

17. The display according to claim 16, wherein the control board further comprises:

a power supply unit, for at least providing the first voltage, the second voltage and the voltage.

18. The display according to claim 17, wherein the compensation unit comprises a diode having an anode directly receiving the first voltage and a cathode receiving the second voltage, and the specific voltage is a forward bias of the diode.

19. The display according to claim 18, wherein the cathode of the diode receives the second voltage through a current limiting resistor.

20. The display according to claim 13, wherein the gate driver is directly disposed on the display panel.

21. The display according to claim 13, wherein the display at least comprises a liquid crystal display (LCD).

* * * * *